US009196947B2

(12) United States Patent
Zhao et al.

(10) Patent No.: US 9,196,947 B2
(45) Date of Patent: Nov. 24, 2015

(54) METHOD FOR MANUFACTURING RESONANT TUBE, RESONANT TUBE AND CAVITY FILTER

(75) Inventors: Kelun Zhao, Shezhen (CN); Fengping Shen, Shenzhen (CN); Bingbing Wan, Shenzhen (CN); Yanzhao Zhou, Shenzhen (CN)

(73) Assignee: SHENZHEN TATFOOK NETWORK TECHNOLOGY CO., LTD., Shenzhen, Guangdong Province (CN)

( * ) Notice: Subject to any disclaimer, the term of this patent is extended or adjusted under 35 U.S.C. 154(b) by 420 days.

(21) Appl. No.: 13/701,511

(22) PCT Filed: Jun. 1, 2011

(86) PCT No.: PCT/CN2011/075128

§ 371 (c)(1),
(2), (4) Date: Jan. 31, 2013

(87) PCT Pub. No.: WO2011/150854

PCT Pub. Date: Dec. 8, 2011

(65) Prior Publication Data

US 2013/0127569 A1 May 23, 2013

(30) Foreign Application Priority Data

Jun. 2, 2010 (CN) ..... 2010 1 0189285

(51) Int. Cl.

| | |
|---|---|
| ***H01P 11/00*** | (2006.01) |
| ***H01P 7/06*** | (2006.01) |
| ***B22F 3/24*** | (2006.01) |
| ***B22F 3/26*** | (2006.01) |
| ***C22C 33/02*** | (2006.01) |
| ***B22F 5/10*** | (2006.01) |

(52) U.S. Cl.

CPC ..... *H01P 11/008* (2013.01); *B22F 5/106* (2013.01); *C22C 33/0285* (2013.01); *H01P 7/06* (2013.01); *H01P 11/002* (2013.01); *B22F 2998/10* (2013.01); *B22F 2999/00* (2013.01)

(58) Field of Classification Search

CPC ..... B22F 2003/248; B22F 2998/10; B22F 2201/013; C22C 33/0285; H01P 11/002; H01P 11/008; H01P 7/06; H01P 3/02; H01P 3/10

USPC ..... 419/30, 38, 27, 29, 5; 333/227

See application file for complete search history.

(56) References Cited

U.S. PATENT DOCUMENTS

| | | | | |
|---|---|---|---|---|
| 5,401,292 | A | 3/1995 | Japka | |
| 8,986,420 | B2 * | 3/2015 | Zhou | 75/252 |
| 2013/0113578 | A1 * | 5/2013 | Zhou | 419/5 |
| 2015/0048904 | A1 * | 2/2015 | Zhou et al. | 419/5 |

FOREIGN PATENT DOCUMENTS

| | | | |
|---|---|---|---|
| CN | 101080161 | A | 11/2007 |
| CN | 201185223 | Y | 1/2009 |

(Continued)

*Primary Examiner* — Helene Klemanski
(74) *Attorney, Agent, or Firm* — Cheng-Ju Chiang

(57) ABSTRACT

A method for manufacturing a resonant tube is provided in the present invention, which comprises: mechanically mixing 88-98 wt. % of iron-nickel alloy powder, 1-8 wt. % of carbonyl iron powder, and 1-8 wt. % of carbonyl nickel powder to form a uniform powder mixture; molding the uniform powder mixture to form a resonant tube blank; and continuously sintering and annealing the resonant tube blank. Also provided in the present invention are a resonant tube and a cavity filter. The method for manufacturing a resonant tube provided in the present invention significantly enhances production efficiency while greatly reducing consumption of raw materials. Moreover, the resonant tube provided in the present invention reduces, to the greatest extent, segregation of alloy components and coarse and uneven microstructures, thereby increasing the performance and stability of the corresponding products.

19 Claims, 3 Drawing Sheets

(56) References Cited

FOREIGN PATENT DOCUMENTS

| | | | |
|---|---|---|---|
| CN | 101656341 | A | 2/2010 |
| CN | 201417811 | Y | 3/2010 |
| CN | 101912967 | A | 12/2010 |

* cited by examiner

METHOD FOR MANUFACTURING RESONANT TUBE, RESONANT TUBE AND CAVITY FILTER

CROSS REFERENCE TO RELATED APPLICATIONS

The present application is a 35 U.S.C. §317 National Phase conversion of International (PCT) Patent Application No. PCT/CN2011/075128, filed on Jun. 1, 2011, the disclosure of which is incorporated by reference herein. The PCT International Patent Application was published in Chinese.

TECHNICAL FIELD

The present invention relates to the field of microwave communication, and particularly relates to a resonant tube and a method for manufacturing the resonant tube, and further relates to a cavity filter using the resonant tube.

BACKGROUND TECHNOLOGY

As a passive filter, the cavity filter has excellent anti-interference performance such that it is widely used in, for example, the field of mobile communications. A cavity filter comprises a cavity body and a cover plate, wherein the cavity body comprises a plurality of cavities, each accommodating a resonant tube. Therefore, a cavity filter includes a plurality of resonant tubes.

The resonant tube is irreplaceable in the cavity filter, and forms a key component that affects the performance of the cavity filter. That is why strict requirements need to be satisfied when manufacturing and processing a resonant tube.

Conventionally, invar steel is used as a raw material for making a resonant tube. Invar steel, a special iron-nickel metal alloy material, has an extremely small thermal expansion coefficient (averagely lower than 10-6/° C. under ambient temperature), and meanwhile exhibits excellent plasticity. The invar steel is conventionally manufactured using a melt casting process.

Upon researches and practices on the prior art, the inventor of the present invention observed the fact that the resonant tube for use in a microwave RF device is more complicated in shape and requires higher accuracy in the manufacture, making the preparation and mechanical processing of a resonant tube with invar steel ingot more costly (higher consumption of raw materials) and limiting the manufacturing efficiency. Moreover, invar steel prepared using a melt casting process tends to incur defects such as segregation of alloy components, and coarse and uneven forged objects. All these drawbacks significantly increase the cost in the manufacture of a resonant tube, and compromise its applications in a microwave resonator.

Furthermore, the conventional cold heading process is mainly used for making such parts as a bolt, nut, nail, rivet, and a steel ball, etc. The materials used for a forging blank may be selected from copper, aluminum, carbon steel, alloy steel, stainless steel and titanium alloy, etc., and the material utilization rate may reach up to 80-90%. However, due to requirements with respect to hardness and expansion coefficient, the conventional materials for making a resonant tube material fail to be molded and formed in one step using the cold heading process.

SUMMARY OF THE INVENTION

To address the aforesaid technical problems, the present invention provides a method for manufacturing a resonant tube, comprising:

mechanically mixing 88-98 wt. % of iron-nickel alloy powder, 1-8 wt. % of carbonyl iron powder, and 1-8 wt. % of carbonyl nickel powder to form a uniform powder mixture;

molding the uniform powder mixture to form a resonant tube blank; and continuously sintering and annealing the resonant tube blank.

To address the aforesaid technical problems, the present invention also provides a cavity filter, the cavity filter comprises a resonate tube, which comprises comprising 88-98 wt. % of iron-nickel alloy, 1-8 wt. % of carbonyl iron, and 1-8 wt. % of carbonyl nickel.

In view of the aforesaid, further provided in the present invention is another method for manufacturing a resonant tube, comprising:

disposing a metal powder in a forming mold;

press molding the metal powder in the forming mold using a pressure machine to form a metal resonant tube; and removing the forming mold off the press molded metal resonant tube and sintering the metal resonant tube.

The present invention fulfills the following advantageous effects: in contrast to the prior art technology, in accordance with the resonant tube and the method of making the same provided in the present invention, an iron-nickel alloy microwave resonant tube of excellent performance is obtained by press molding or injection molding iron-nickel alloy powder prepared using powder metallurgical technology, and subjecting the molded product to heat treatments. As compared to the conventional melt casting technology, the present invention can reduce, to a great extent, the chances of segregation of alloy components, and coarse and uneven microstructures, thereby increasing the quality and stability of the corresponding products. Meanwhile, the present invention eliminates or reduces the need of a cutting process, enabling a near net shape for the resonant tube and automatic mass production thereof and thus significantly reducing consumption of raw materials.

Furthermore, the methods for manufacturing a resonant tube proposed in the present invention produce a resonant tube, which has desired hardness, thermal expansion coefficient and toughness, using a cold heading technique which reduces consumption of raw materials and increases processing efficiency.

BRIEF DESCRIPTION OF THE DRAWING

To render the technical solutions described in the embodiments of the present invention more apparent, a brief introduction is given hereunder to the figures which the embodiments to be set forth below may refer to. Obviously, the figures to be described hereunder are not exhaustive, and persons of ordinary skill in the art would be able to obtain, based on these figures, other figures without exercising inventive skills.

DETAILED DESCRIPTION OF THE EMBODIMENTS

The technical solutions employed in the embodiments of the present invention are hereunder described to a great length with reference to the aforesaid figures. Apparently, these embodiments are not exhaustive. Any other embodiments, which persons skilled in the art obtain based on the embodiments set forth in the present invention without exercising inventive skills, should also be construed to fall into the scope of the present invention.

In the embodiments of the present invention, a method for manufacturing a resonant tube is provided, which comprises: mechanically mixing 88-98 wt. % of iron-nickel alloy powder, 1-8 wt. % of carbonyl iron powder, and 1-8 wt. % of carbonyl nickel powder to form a uniform powder mixture; molding the uniform powder mixture to form a resonant tube blank; and continuously sintering and annealing the resonant tube blank.

Also provided in the embodiments is a resonant tube, which comprises: 88-98 wt. % of iron-nickel alloy, 1-8 wt. % of carbonyl iron, and 1-8 wt. % of carbonyl nickel.

The embodiments of the present invention also disclose a cavity filter, which comprises the aforesaid resonant tube.

The embodiments of the present invention further provide a method for manufacturing a resonant tube, comprising: preparing a resonant tube blank using 88-98 wt. % of iron-nickel alloy, 1-8 wt. % of carbonyl iron, 1-8 wt. % of carbonyl nickel, and a lubricant taking up 1-4 wt. % of the total weight of the iron-nickel alloy, carbonyl iron, and carbonyl nickel; continuously sintering and annealing the blank to form an iron-nickel alloy bar; performing a cold heading process on the bar to form a cold-headed resonant tube; and performing a thermal treatment on the cold-headed resonant tube.

In still another embodiment is provided a method for manufacturing a resonant tube, comprising: disposing a metal powder in a forming mold; press molding the metal powder in the forming mold using a pressure machine to form a metal resonant tube; and removing the forming mold off the press molded metal resonant tube and sintering the metal resonant tube.

Embodiment I

Figure 1:
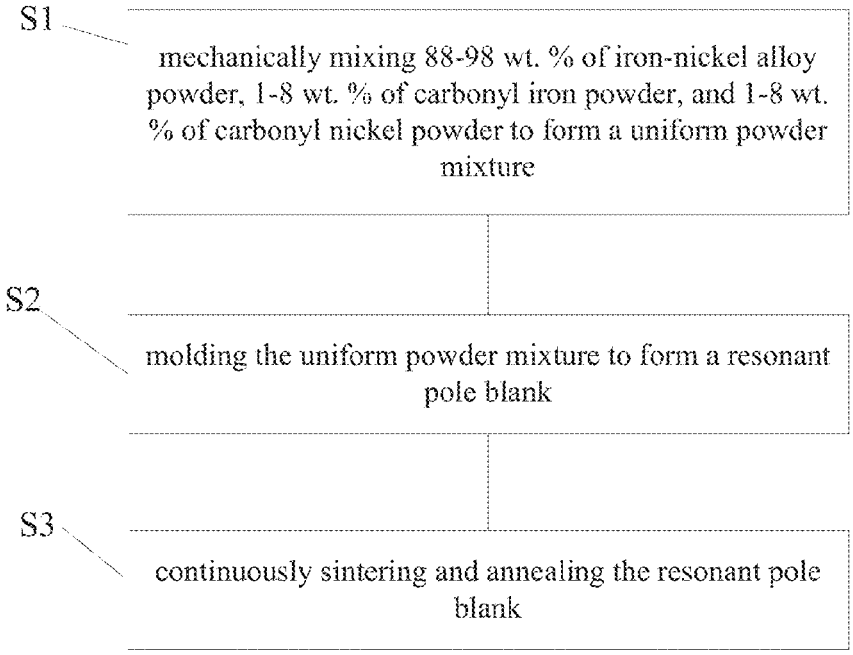
FIG. 1 illustrates a flow diagram of a method for manufacturing a resonant tube according to one embodiment of the present invention.

A method for manufacturing a resonant tube as shown in FIG. 1 is provided, which comprises:

Step S1: mechanically mixing 88-98 wt. % of iron-nickel alloy powder, 1-8 wt. % of carbonyl iron powder, and 1-8 wt. % of carbonyl nickel powder to form a uniform powder mixture;

In this embodiment, the iron-nickel alloy powder is preferably 92-96 wt. %; the carbonyl iron powder is preferably 2-4 wt. %; and the carbonyl nickel powder is preferably 2-4 wt. %. In the most preferred aspect, the iron-nickel alloy powder is 94 wt. %; the carbonyl iron powder is 3 wt. %; and the carbonyl nickel powder is 3 wt. %. It bears mentioning that these raw materials inevitably comprise a small amount of impurities, including carbon, nitrogen, sulfur and phosphor, which generally are not more than 0.1%.

In this embodiment, the iron-nickel alloy powder, the carbonyl iron powder, and the carbonyl nickel powder are uniformly and mechanically mixed with a stearic acid lubricant which takes up 1-4 wt. % of the iron-nickel alloy powder using a mechanical ball-mixing process. The mechanical ball-mixing process may use zirconia as a ball milling medium, wherein the ball-to-powder ratio may be set to 10:1, and the milling time may be set to 5 to 12 hours. Of course, the ball-to-powder ratio and the ball-milling time may be adjusted as needed.

The preparation of the iron-nickel alloy powder is introduced below:

According to the embodiment of the present invention, pure iron and pure nickel are prepared into an alloy powder comprising 36 wt. % of nickel and 64 wt. % of iron using an ultrahigh pressure water or gas atomization technique. After operations including dehydration, drying, screening, powder high-temperature reduction, cake-crushing, screening, and blending etc., high-purity alloy powder containing 36 wt. % of nickel and 64 wt. % of iron will finally be obtained, which is ball- or blob-shaped particles. The pure iron preferably has a purity of greater than 99.95%, and pure nickel has a purity of greater than 99.6%. Since the ultrahigh pressure water or gas atomization technique has been familiar to persons skilled in the art, it is not introduced in details herein.

In step S1, the stearic acid lubricant may provide optimum lubricant effects to the alloy powder so as to reduce the friction between various powders. In a preferred embodiment, the stearic acid lubricant takes up 1-4 wt. %, and most preferably 2 wt. % of the iron-nickel alloy powder.

The aforesaid carbonyl nickel powder and carbonyl iron powder are both high purity powder particles having a special crystalline structure and an extremely low amount of carbon, forming an ideal composite material for mixing with the iron-nickel powder. Due to a dentritic surface, the carbonyl nickel powder and the carbonyl iron powder can be closely combined with large particles to form a stable and uniform distribution before being sintered. Moreover, during the subsequent sintering process, they can be uniformly diffused with respect to the rest of the powders, eventually forming a precision component having a balanced metallurgical structure. They play a very important role in acquiring a desired thermal expansion coefficient for a resonant tube.

Step S2: molding the uniform powder mixture to form a resonant tube blank;

According to the embodiment of the present invention, the powder mixture is disposed in a forming mold for one-step molding under, for example, 100-ton oil hydraulic pressure. With the forming mold being removed, the one-step molded iron-nickel resonant tube blank will be obtained.

In an alternative embodiment, the powder mixture may be disposed in a high pressure injection molding machine for one-step injection molding to also obtain one-step molded iron-nickel resonant tube blank.

Of course, during the aforesaid one-step molding process, dependent on actual circumstances, the materials may be manually or automatically fed to the molding machine.

Step S3: continuously sintering and annealing the resonant tube blank;

In this embodiment, the resonant tube blank is continuously sintered under the highest temperature ranging between 1250° C. and 1550° C. for 3-10 hours. An annealing process is then conducted under a temperature ranging between 1050° C. and 1250° C. for 5 to 12 hours, with hydrogen being used as a reducing gas. Thereafter, it is possible to obtain an iron-nickel resonant tube which not only has a very high density, but also eliminates the need of subsequent mechanical processing.

Preferably, in this embodiment, the sintering process is carried out under the highest temperature ranging between 1350° C. and 1450° C. for 3 to 6 hours; the annealing is conducted under a temperature ranging between 1100° C. and 1200° C. for 5 to 8 hours. Most preferably, the sintering is carried out under the highest temperature of 1400° C. for 4 hours; and the annealing is conducted under a temperature of 1150° C. for 6 hours.

It is worth mentioning that upon the aforesaid one-step molding and the continuous sintering, the aforesaid stearic acid lubricant has been vaporized due to the high temperature, and therefore will not be present in the iron-nickel resonant tube.

According to the embodiment of the present invention, the method may further comprise the following step after continuously sintering and annealing the resonant tube blank:

electroplating the thermally treated iron-nickel resonant tube, wherein the resonant tube is first plated with copper and then with silver. Thereafter, the one-step molded iron-nickel resonant tube may be directly mounted in a cavity filter.

In accordance with the embodiments, the present invention obtains a resonant tube by press molding, in one step, a uniform powder mixture which mainly comprises high purity iron-nickel alloy powder prepared using an ultrahigh pressure atomization technique. By subsequently applying appropriate sintering and annealing processes, the present invention is able to produce an iron-nickel microwave resonant tube, which has high performance, and a near net shape. Therefore, the produced resonant tube can reduce, to the greatest extent, the chances of segregation of alloy components, and coarse and uneven microstructures, increasing the quality and stability of the corresponding products as well as the production efficiency while significantly reducing consumption of raw material and cost in mechanical processing. Moreover, as the size of the one-step molded iron-nickel resonant tube and the property of the materials are both consistent, the one-step molded iron-nickel resonant tube may be directly used in a microwave resonator.

Hereunder applications of the aforesaid embodiments under particular circumstances are illustrated in details with reference to Table 1 below.

Table 1 illustrates relationship between powder mixtures with different ratios of powders, thermal treatment conditions (sintering and annealing), and parameters of a corresponding cavity filter with a single cavity.

| Wt. % of powders to be mixed (iron-nickel alloy powder, carbonyl iron powder, and carbonyl nickel powder in series) | highest sintering temperature and sintering time | annealing temperature and annealing time | resonance frequency and temperature drift |
|---|---|---|---|
| 88%, 6%, 6% | 1450° C., 10 h | 1150° C., 12 h | 2900 MHz; 0.32 MHz |
| 90%, 5%, 5% | 1350° C., 8 h | 1100° C., 8 h | 3200 MHz; 0.33 MHz |
| 92%, 4%, 4% | 1250° C., 6 h | 1050° C., 3 h | 3500 MHz; 0.27 MHz |
| 94%, 3%, 3% | 1150° C., 6 h | 1050° C., 3 h | 3500 MHz; 0.24 MHz |
| 96%, 2%, 2% | 1250° C., 8 h | 1150° C., 8 h | 3300 MHz; 0.28 MHz |
| 98%, 1%, 1% | 1350° C., 10 h | 1250° C., 12 h | 3100 MHz; 0.35 MHz |

The first application embodiment listed in Table 1 is illustrated below only. The same principle may apply to the rest of the application embodiments.

Application Embodiment 1

88% of high purity iron-nickel alloy powder, 6% of carbonyl iron powder, 6% of carbonyl nickel powder, which are prepared using powder metallurgical technology, and a stearic acid lubricant occupying 1-2% of the total weight of the aforesaid powders, are press molded in one step. The press molded product is then subjected to a continuous sintering process (under the highest temperature of 1450° C. for 10 hours) and an annealing process under the reducing atmosphere of $H_2$ (under the temperature of 1150° C. for 12 hours). Thereafter, an electroplating process is carried out to obtain an iron-nickel resonant tube having an outer diameter of 10.0 mm, and a highness of 11.8 mm. It is observed from testing that the corresponding cavity filter with a single cavity has a resonant frequency up to 2900 MHz, and a temperature drift lower than 0.32 MHz.

Embodiment II

Figure 2:
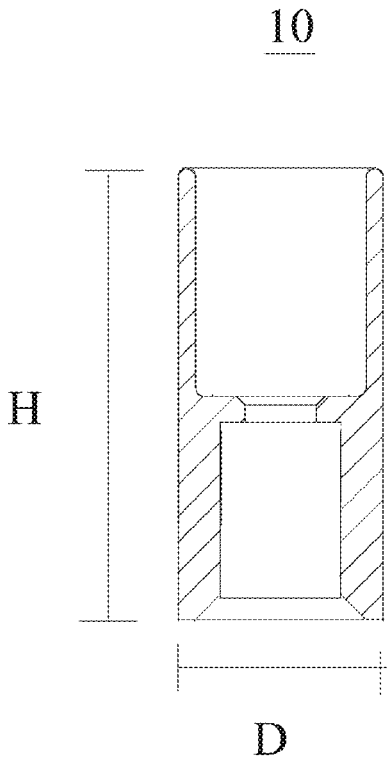
FIG. 2 illustrates the structure of a resonant tube according to another embodiment of the present invention.

A resonant tube 10 having a structure as shown in FIG. 2 is provided in this embodiment, which has a highness of H and an outer diameter of D. Resonant tube 10 comprises 88-98 wt. % of iron-nickel alloy, 1-8 wt. % of carbonyl iron, and 1-8 wt. % of carbonyl nickel.

In this embodiment, the iron-nickel alloy, the carbonyl iron, and the carbonyl nickel are press molded or injection molded to form a resonant tube.

The resonant tube prepared from the iron-nickel alloy, the carbonyl iron, and the carbonyl nickel mixed in the aforesaid ratios using one-step molding significantly reduces consumption of raw materials and the cost in mechanical processing.

In this embodiment, preferably, the iron-nickel alloy is of 92-96 wt. %, the carbonyl iron of 2-4 wt. %, and the carbonyl nickel of 2-4 wt. %. In the most preferred embodiment, the iron-nickel alloy is of 94 wt. %, the carbonyl iron of 3 wt. %, and the carbonyl nickel of 3 wt. %.

Figure 3:
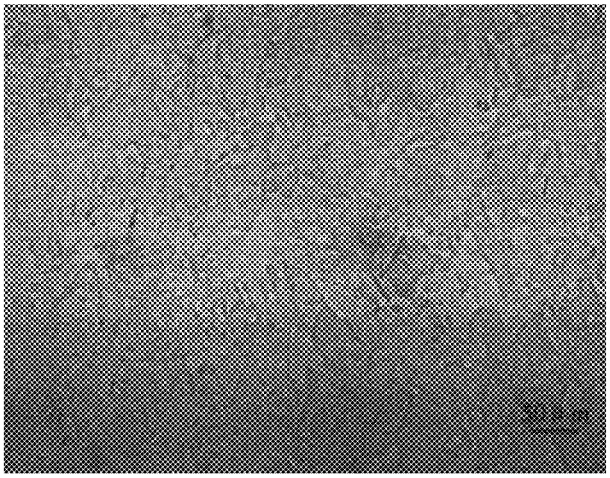
FIG. 3 illustrates a micro-picture of the profile of the resonant tube shown in FIG. 2.

According to a further embodiment of the present invention, the aforesaid iron-nickel alloy, the carbonyl iron, and the carbonyl nickel are uniformly mixed as powders before being molded to obtain the resonant tube. In particular, the iron-nickel alloy powder may be ball- or blob-shaped particles. The crystalline particles of the resonant tube have an average size of less than 50 μm, and are distributed uniformly and densely, thereby ensuring the testing properties of the corresponding microwave resonant tube. Reference may be made to FIG. 3 for details, which illustrates a micro picture of the profile of the resonant tube shown in FIG. 1, i.e., a phase diagram.

According to a further embodiment of the present invention, the iron-nickel alloy comprises 36 wt. % of nickel and 64 wt. % of iron, and the iron-nickel alloy powder is prepared using an ultrahigh pressure water or gas atomization technique.

In a further embodiment, the uniform powder mixture that mainly comprises high purity iron-nickel alloy powder prepared using an ultrahigh pressure water or gas atomization technique is press molded in one step to form a resonant tube. The resultant resonant tube has a near net shape and high performance such that it reduces, to the greatest extent, segregation of alloy components, and coarse and uneven microstructures, thereby increasing the performance and stability of the corresponding product.

Embodiment III

A resonant tube is provided in this embodiment, which comprises 88-98 wt. % of iron-nickel alloy, 1-8 wt. % of carbonyl iron, and 1-8 wt. % of carbonyl nickel. Besides, the iron-nickel alloy, the carbonyl iron, and the carbonyl nickel are uniformly mixed as powders and then molded to obtain the resonant tube.

In this embodiment, a uniform powder mixture that mainly comprises the iron-nickel alloy powder is molded to form a resonant tube. The resultant resonant tube is an iron-nickel microwave resonant tube of high performance. It reduces, to the greatest extent, segregation of alloy components, and coarse and uneven microstructures, thereby increasing the performance and stability of the corresponding product.

According to a further embodiment, the iron-nickel alloy is of 92-96 wt. %, the carbonyl iron of 2-4 wt. %, and the carbonyl nickel of 2-4 wt. %. The iron-nickel alloy comprises 36 wt. % of nickel and 64 wt. % of iron, and the iron-nickel alloy powder is prepared using an ultrahigh pressure water or gas atomization technique. The iron-nickel alloy powder may be shaped like a ball particle or a blob particle.

In a further embodiment, the crystalline particles of the resonant tube have an average dimension of less than 50 μm, and are distributed uniformly and densely.

Embodiment IV

Provided in this embodiment is a cavity filter, which comprises the aforesaid resonant tube.

Embodiment V

Figure 4:
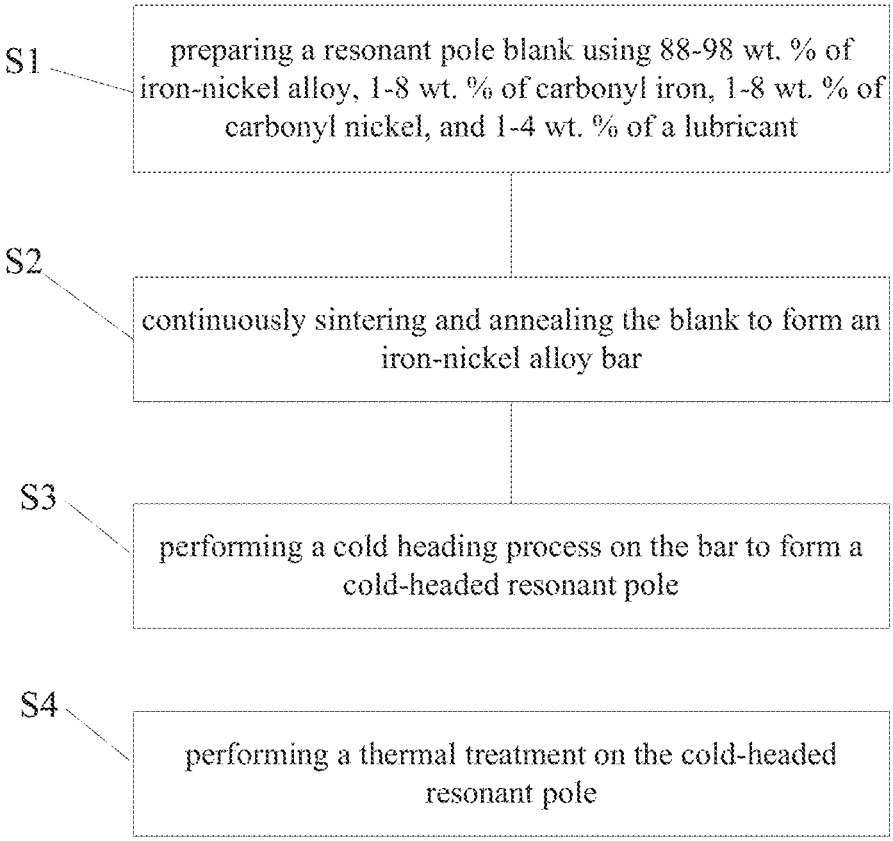
FIG. 4 illustrates a flow diagram of a method for manufacturing a resonant tube according to another embodiment of the present invention.

The present invention provides another method for manufacturing a resonant tube as shown in FIG. 4, which comprises:

Step S1: preparing a resonant tube blank from 88-98 wt. % of iron-nickel alloy, 1-8 wt. % of carbonyl iron, 1-8 wt. % of carbonyl nickel, and a lubricant of 1-4 wt. % of the total weight of the aforesaid powders.

In this step, pure iron having a purity of greater than 99.95% and pure nickel having a purity of greater than 99.6% are employed as raw materials to eventually prepare iron-nickel alloy powder of small particles using an ultrahigh pressure water or gas atomization technique. The resultant iron-nickel alloy is then subjected to operations including dehydration, drying, screening, powder high-temperature reduction, cake-crushing, screening, and blending etc., to obtain high purity iron-nickel alloy powder containing 36% of nickel. The obtained high purity iron-nickel alloy powder is then mechanically mixed with carbonyl iron powder, carbonyl nickel powder and a lubricant to allow a uniform and refinement powder mixture. In the present invention, the lubricant mainly functions to facilitate the formation of a uniform mixture from the aforesaid metal powders and the alloy powder. The lubricant may be selected from a group consisting of a stearic acid lubricant, ceresin wax, polyvinyl alcohol and other lubricants having the same function. The resultant uniform and refinement powder mixture is subsequently disposed in a forming mold of a molding machine, where it is press molded in one step under an oil hydraulic pressure not less than the gravity of a 100-ton object. The forming mold is then removed to obtain a one-step molded iron-nickel alloy blank for the resonant tube.

Step S2: sintering and annealing the blank to obtain an iron-nickel alloy bar;

Step S3: performing a cold heading process on the iron-nickel alloy bar to form a cold-headed resonant tube;

This step is concerned with a cold heading process on the iron-nickel alloy bar. The corresponding mold for the cold heading process is designed dependent on the desired dimension of the resultant resonant tube, and parameters of the cold heading equipment are then configured based on the designed mold. Subsequently, the iron-nickel alloy bar is introduced into the equipment, where dependent on the requirements on the resonant tube, the bar is subjected to operations including cropping, upsetting, accumulating, shaping, chamfering, thread rolling, diameter shrinking and edge trimming before it is finally cold headed or cold extruded to eventually mold the resonant tube in one step. The one-step molded resonant tube may reduce the need of or even skip such a precision treatment as cutting on the resonant tube.

Step 4: performing a thermal treatment on the cold-headed resonant tube;

The existing cold heading techniques do not include a thermal treatment on the cold-headed product. In contrast, the present invention conducts a thermal treatment on the cold-headed product to obtain a resonant tube having high density and glossness without the need of subsequent mechanical processing. Upon the thermal treatment, electroplating is conducted on the resonant tube, wherein the resonant tube is first plated with copper over its surface and then silver. The electroplated resonant tube exhibits an optimum surface smoothness, thereby avoiding absorption of and interference to the microwave energy which otherwise occurs to a coarse surface.

This embodiment is better characterized with reference to the following particular applications thereof:

Application Embodiment 2

98 wt. % of water atomized iron-nickel alloy powder, 1 wt. % of carbonyl iron powder, 1 wt. % of carbonyl nickel powder, and a lubricant of 1 wt. % of the total weight of the aforesaid powders are employed as raw materials to prepare a resonant tube blank. The lubricant may be selected from a group consisting of a stearic acid lubricant, ceresin wax, and polyvinyl alcohol. In this embodiment, a stearic acid lubricant is selected. This step comprises forming iron-nickel alloy powder containing 36% of nickel from pure iron having a purity of greater than 99.95% and pure nickel having a purity of greater than 99.6% using an ultrahigh pressure water or gas atomization technique. The resultant iron-nickel alloy powder is then subjected to operations including dehydration, drying, screening, high-temperature reduction, cake-crushing, screening, and blending etc., to eventually obtain high purity iron-nickel alloy powder containing 36% of nickel. The obtained high purity iron-nickel alloy powder is then mechanically mixed with the carbonyl iron powder, the carbonyl nickel powder and the lubricant to allow a uniform and refinement powder mixture. Subsequently, the powder mixture is disposed in a forming mold, where it is press molded in one step under an oil hydraulic pressure not less than 100 tons. The forming mold is then removed to obtain the one-step molded iron-nickel alloy blank of the resonant tube.

The aforesaid blank is then subjected to sintering and thermal treatments to give an iron-nickel alloy bar. During these treatments, the blank is sintered under a temperature ranging between 1350° C. and 1550° C. for 3 to 10 hours. Upon sintering, the blank is annealed in a reducing atmosphere of $H_2$ under a temperature ranging from 1050° C. to 1250° C. for 5 to 12 hours. In this embodiment, the blank is sintered at a temperature of 1550° C. for 10 hours before being annealed at a temperature of 1250° C. for 12 hours. So far, the processing on the iron-nickel alloy bar has been finished. A testing demonstrates that the obtained iron-nickel alloy bar exhibits an impact toughness of 227.2 J/cm$^2$, a contraction of area rate of 74% and an expansion coefficient of $4.0\times10^{-6}$/K.

Having been sintered and thermally treated as above, the iron-nickel alloy bar is subjected to a cold heading process. The corresponding mold for the cold heading process is designed dependent on the desired dimension of the resultant resonant tube, and parameters of the cold heading equipment are then configured based on the designed mold. Subsequently, the iron-nickel alloy bar is introduced into the equipment, where dependent on the requirements on the resonant tube, the bar is subjected to operations including cropping, upsetting, accumulating, shaping, chamfering, thread rolling, diameter shrinking and edge trimming before it is finally cold headed or cold extruded to eventually mold the resonant tube in one step. The one-step molded resonant tube may reduce the need of or even skip such a precision treatment as cutting on the resonant tube.

The cold-headed resonant tube is then thermally treated. The existing cold heading techniques do not include a thermal treatment on the cold-headed product. In contrast, the present invention conducts a thermal treatment on the cold-headed product to obtain a resonant tube having high density and glossness without the need for subsequent mechanical processing.

Upon the thermal treatment, electroplating is conducted on the resonant tube, wherein the resonant tube is first plated with copper over its surface and then silver.

The resonant tube obtained in accordance with the method described in this embodiment mainly consists of 98 wt. % of iron-nickel alloy, 1 wt. % of carbonyl iron, and 1 wt. % of carbonyl nickel. After establishing the resonant tube in a cavity filter, it is found upon testing that the cavity filter with a single cavity has a resonant frequency up to 3500 MHz, and a temperature drift of less than 0.4 MHz.

Application Embodiment 3

88 wt. % of gas atomized iron-nickel alloy powder, 6 wt. % of carbonyl iron powder, 6 wt. % of carbonyl nickel powder, and a stearic acid lubricant of 4 wt. % of the total weight of the aforesaid powders are employed as raw materials to prepare a resonant tube blank. The sintering and thermal treatments on the blank are designed as follows: the blank is sintered under a temperature of 1350° C. for 3 hours, and then annealed under a temperature of 1050° C. for 5 hours. Reference may be made to the aforesaid Embodiment 1 for detailed steps of making the blank and the iron-nickel alloy bar. Details are omitted here.

A testing demonstrates that the obtained iron-nickel alloy bar exhibits an impact toughness of 263.5 J/cm$^2$, a contraction of area rate of 68% and an expansion coefficient of $2.7\times10^{-6}$/K.

After establishing the resonant tube in a cavity filter, it is observed that the cavity filter with a single cavity has a resonant frequency up to 3500 MHz, and a temperature drift of less than 0.3 MHz.

Application Embodiment 4

93 wt. % of water atomized iron-nickel alloy powder, 4 wt. % of carbonyl iron powder, 3 wt. % of carbonyl nickel powder, and a stearic acid lubricant of 2 wt. % of the total weight of the aforesaid powders are employed as raw materials to prepare a resonant tube blank. The sintering and thermal treatments on the blank are designed as follows: the blank is sintered under a temperature of 1450° C. for 6 hours, and then annealed under a temperature of 1100° C. for 8 hours. Reference may be made to the aforesaid Embodiment 1 for detailed steps of making the blank and the iron-nickel alloy bar. Details are omitted here.

A testing demonstrates that the obtained iron-nickel alloy bar exhibits n impact toughness of 317.6 J/cm$^2$, a contraction of area rate of 62% and an expansion coefficient of $1.8\times10^{-6}$/K.

After establishing the resonant tube in a cavity filter, it is observed that the cavity filter with a single cavity has a resonant frequency up to 3500 MHz, and a temperature drift of less than 0.2 MHz.

Embodiment VI

Figure 5:
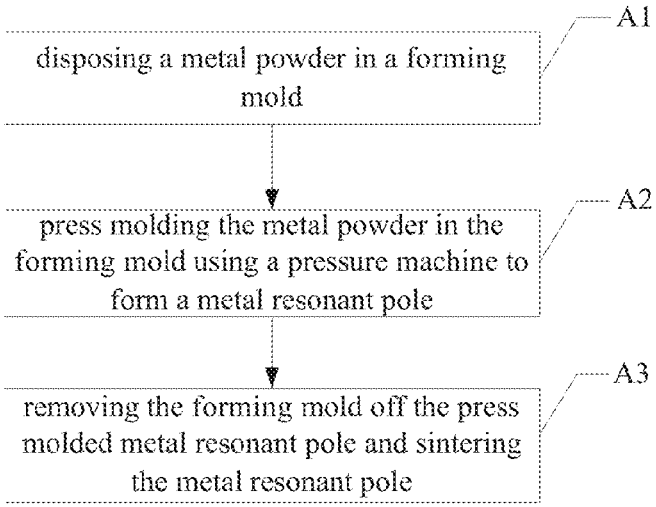
FIG. 5 illustrates a flow diagram of a method for manufacturing a resonant tube according to still another embodiment of the present invention.

A method for manufacturing a resonant tube as shown in FIG. 5 is provided, which comprises:

Step A1: disposing a metal powder in a forming mold;

In this embodiment, the metal powder, which is prepared in advance, may be a mixture of one or more metals and one or more auxiliary materials. The one or more auxiliary materials facilitate the molding of the resonant tube. Of course, it would be appreciated that the metal powder may comprise pure metals without including any auxiliary materials. What types of metals are chosen does not limit the scope of the present invention.

As one of the examples, the metal powder comprises 88-98 wt. % of iron-nickel alloy, 1-8 wt. % of carbonyl iron, 1-8 wt. % of carbonyl nickel, and a lubricant of 1-4 wt. % of the total weight of the iron-nickel alloy, the carbonyl iron and the carbonyl nickel. These iron-nickel alloy, carbonyl iron, carbonyl nickel and lubricant are the same as described in the embodiments supra, and thus are not described in details here again.

A2: press molding the metal powder in the forming mold using a pressure machine to form a metal resonant tube;

The press molding process needs to be dependent upon the mold. Molds having different shapes and dimensions lead to different resonant tubes. The selection of the mold is not construed as a limitation to the scope of the present invention.

A3: removing the forming mold off the press molded metal resonant tube and sintering the metal resonant tube;

Only upon a sintering treatment will the press molded resonant tube have a desired strength and meet the requirements.

According to the embodiment of the present invention, the metal resonant tube is press molded using a pressure machine, which, as compared with the conventional CNC processing, reduces the cost in raw materials and meanwhile does not produce wasted materials. Besides, the changed processing technique in this embodiment enables the molding equipment to mold more than one resonant tube at one time, significantly increasing production efficiency.

Embodiment VII

Figure 6:
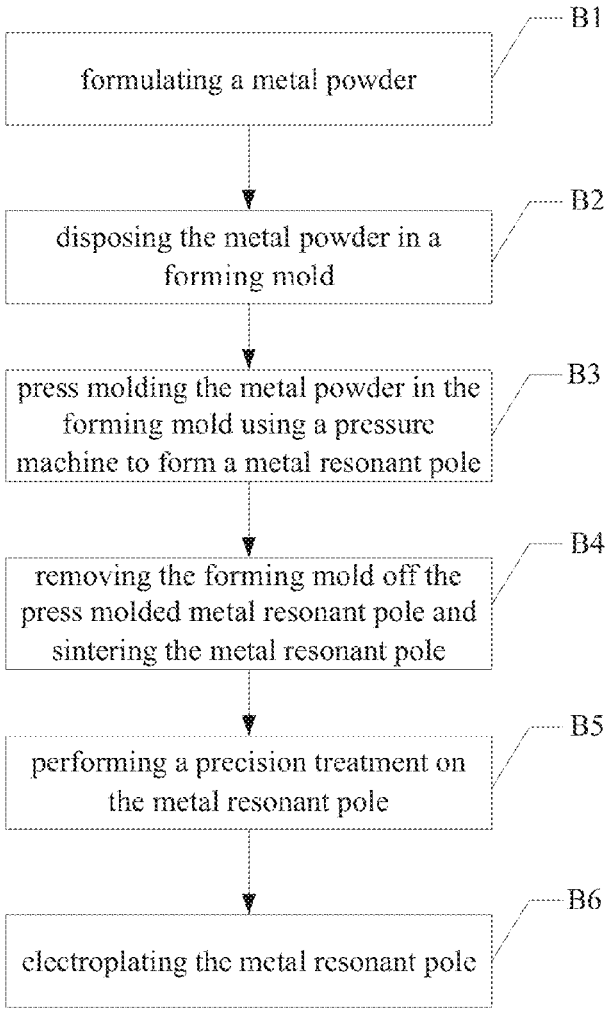
FIG. 6 illustrates a flow diagram of a method for manufacturing a resonant tube according to still another embodiment of the present invention.

A method for manufacturing a resonant tube as shown in FIG. 6 is provided, which comprises:

Step B1: formulating a metal powder;

The formulation of the metal powder comprises mixing a metal powder with an auxiliary material to form an adhesive metal powder mixture. The particular selection of metals, auxiliary material, and the ratios thereof is not construed to limit the scope of the present invention.

Generally, the auxiliary material may be selected from one or more of a lubricant, carbon powder, and an adhesive; and the metal powder may comprise one or more of iron powder, copper powder and steel powder. In particular, the iron powder may be selected as a reduced iron powder or atomized iron powder.

Different types of metals to be mixed in different ratios may lead to different linear expansion coefficients of the resonant tube and thereby adjustable temperature drifts.

Step B2: disposing the metal powder in a forming mold;

Step B3: press molding the metal powder in the forming mold using a pressure machine to form a metal resonant tube;

The press molding process needs to be dependent upon the mold. Molds having different shapes and dimensions lead to different resonant tubes. The selection of the mold is not construed as a limitation to the scope of the present invention.

The pressure machine may be selected from an oil hydraulic machine or an air pressure machine that is specially designed for pressing powder. The particular selection of the pressure and the pressure machine depends on the size of the resonant tube to be manufactured as well as the raw materials, and does not serve as a limitation to the scope of the present invention.

B4: removing the forming mold off the press molded metal resonant tube and sintering the metal resonant tube;

In this embodiment, the one-step molded resonant tube is generally sintered at a temperature ranging from 800 to 1200° C. The particular temperature is dependent on the raw materials for making the resonant tube, and does not serve as a limitation to the scope of the present invention.

Only upon a sintering treatment will the press molded resonant tube have a desired strength and meet the other requirements.

B5: performing a precision treatment on the metal resonant tube;

The precision treatment mentioned in this embodiment is carried out with an attempt to meet the requirement on the size difference of the prepared resonant tube, and other requirements with respect to flatness, surface smoothness, and surface finish, etc. The precision treatment may include various processing, for example, a shaping process or a pore expanding process on the resonant tube. Of course, the precision treatment may include other processing that has been conventionally used in the art. The particular implementation of the precision treatment is not construed as a limitation to the scope of the present invention.

B6: electroplating the metal resonant tube;

In this embodiment, the electroplating is carried out to obtain a flat and smooth surface of the resonant tube, and optimize various parameters of the corresponding filter. In particular, the electroplating may comprise plating the metal resonant tube with copper, and then plating the coppered metal resonant tube with silver. Of course, the resonant tube may be plated with copper only, or plated with silver directly. The electroplating may be implemented in various manners. Dependent on different requirements and parameters with respect to the product, the electroplating may be implemented in different manners with different materials.

It would be appreciated that before performing the electroplating at Step B6, the following step may be executed: impregnating the metal resonant tube that has been subjected to the aforesaid precision treatment with an organic solvent to seal the pore. This is done because the resonant tube is press molded from metal powder or small metal particles, whose textures are loose to a certain extent. When put under a microscope, the texture and distribution of the internal metal powder/particles within the resonant tube are rather obvious. Therefore, by sealing the pores, the subsequent electroplating process may be facilitated and improved.

In accordance with the methods for molding the resonant tube proposed in the present invention, the materials for making the resonant tube and the ratios thereof are adjustable. Therefore, for the metal resonant tube, it is possible to adjust, by varying the metal powder materials in the resonant tube and the ratios thereof, various parameters of a filter using the resonant tube, and moreover it is possible to adjust the linear expansion coefficient of the resonant tube and in turn obtain a controllable temperature drift.

The methods provided in the present invention produce a novel, one-step molded resonant tube which is cost effective with respect to raw materials, can be molded fast, and have consistent dimensions. Generally, it only takes about 3 seconds to form the resonant tube by press molding, so small equipment is capable of producing more than 10 resonant tubes each time, significantly increasing the production efficiency.

Persons skilled in the art would understand that all or part of the steps included in the methods disclosed in the aforesaid embodiments may be implemented by hardware with program instructions. These programs may be stored in a computer accessible storage medium, which, when executed, perform the steps described supra. Said storage medium comprises a Read-Only Memory (ROM), a Random Access Memory (RAM), a diskette, a disk or the like medium which is capable of storing various program codes.

While the present invention is described with reference to particular embodiments, these embodiments should not be construed to restrict the scope of the present invention. Any equivalent variations to the structures or flows disclosed in the description and the drawing of the present invention, or any direct or indirect applications of the present invention to other related technical fields are also considered to be part of the present invention.

What we claim is:

1. A method for manufacturing a resonant tube, comprising:

mechanically mixing 88-98 wt. % of iron-nickel alloy powder, 1-8 wt. % of carbonyl iron powder, and 1-8 wt. % of carbonyl nickel powder to form a uniform powder mixture;

molding the uniform powder mixture to form a resonant tube blank; and continuously sintering and annealing the resonant tube blank.

2. The method according to claim 1, wherein the method further comprises preparing the iron-nickel alloy powder before said mechanically mixing, wherein preparing the iron-nickel alloy powder comprises preparing an alloy powder by selecting purity iron material and purity nickel and utilizing an ultrahigh pressure water or gas atomization technique to manufacture ball- or blob-shaped particles which comprises 36 wt. % of nickel and 64 wt. % iron.

3. The method according to claim 1, wherein said mechanically mixing comprises: mechanically mixing, utilizing a mechanical ball-mixing process, the iron-nickel alloy powder, the carbonyl iron powder, and the carbonyl nickel powder with a lubricant which takes up 1-4 wt. % of the iron-nickel alloy powder to form a uniform powder mixture.

4. The method according to claim 1, wherein said molding comprises: disposing the powder mixture in a mold to press mold the powder mixture in one-step press forming.

5. The method according to claim 1, wherein said molding comprises: disposing the powder mixture in a high pressure injection molding machine to injection mold the powder mixture in one-step injection forming.

6. The method according to claim 1, wherein said continuously sintering and annealing the resonant tube blank comprises: sintering the resonant tube blank at a highest temperature ranging between 1250° C. and 1550° C. for 3-10hours; and annealing the resonant tube blank at a temperature ranging between 1050° C. and 1250° C. for 5 to 12 hours, with hydrogen being utilized as a reducing gas.

7. A cavity filter, comprising a resonant tube which comprises 88-98 wt. % of iron-nickel alloy, 1-8 wt. % of carbonyl iron, and 1-8 wt. % of carbonyl nickel.

8. The cavity filter according to claim 7, wherein the resonant tube has an average crystalline size of less than 50 μm and wherein crystalline particles are distributed uniformly and densely.

9. The cavity filter according to claim 7, wherein the iron-nickel alloy is of 92-96 wt. %; the carbonyl iron is of 2-4 wt. %; and the carbonyl nickel is of 2-4 wt. %.

10. The cavity filter according to claim 7, wherein the iron-nickel alloy, the carbonyl iron, and the carbonyl nickel are uniformly mixed as powders before being molded to form the resonant tube.

11. The cavity filter according to claim 10, wherein the iron-nickel alloy comprises 36 wt. % of nickel and 64 wt. % of iron, and wherein the iron-nickel alloy powder is prepared utilizing an ultrahigh pressure water or gas atomization technique.

12. A method for manufacturing a resonant tube, comprising:

disposing a metal powder in a forming mold;

press molding the metal powder in the forming mold utilizing a pressure machine to form a metal resonant tube; and removing the forming mold off the press molded metal resonant tube and sintering the metal resonant tube.

13. The method according to claim 12, wherein the method further comprises formulating a metal powder before said disposing the metal powder in a forming mold, wherein formulating a metal powder comprises: mixing a metal powder and an auxiliary material to form an adhesive metal powder mixture.

14. The method according to claim 13, wherein the metal powder comprises one or more of iron powder, copper powder and steel powder, the iron powder being a reduced iron powder or an atomized iron powder.

15. The method according to claim 12, wherein after said sintering the metal resonant tube, the method further comprises: electroplating the metal resonant tube, wherein electroplating the metal resonant tube comprises first electroplating the metal resonant tube with copper, and then electroplating the surface of the coppered resonant tube with silver.

16. The method according to claim 15, wherein the method further comprises, before electroplating the metal resonant tube, impregnating the metal resonant tube which has been subjected to a precision treatment with an organic solvent to perform a pore sealing process thereon.

17. The method according to claim 3, wherein the lubricant is a stearic acid lubricant.

18. The method according to claim 1, further comprising: after said molding, performing a cold heading process on the resonant tube to form a cold-headed resonant tube.

19. The method according to claim 18, further comprising: after said cold heading process, performing a thermal treatment on the resonant tube.

* * * * *